United States Patent [19]

Moffatt

[11] 4,003,459

[45] Jan. 18, 1977

[54] WRITING MACHINES

[76] Inventor: Robert Adolphus Guy Moffatt, 9 Rodfords Mead, Hengrove, Bristol, England

[22] Filed: Nov. 26, 1974

[21] Appl. No.: 527,276

[30] Foreign Application Priority Data

Nov. 28, 1973 United Kingdom ..... 55182/73

[52] U.S. Cl. ..... 197/1 R; 197/107

[51] Int. Cl.[2] ..... B41J 3/06

[58] Field of Search ..... 197/1, 107; 33/1 M, 33/18 R, 26, 27 R

[56] References Cited

UNITED STATES PATENTS

| | | | |
|---|---|---|---|
| 4,271 | 11/1845 | Thurber | 197/1 R |
| 1,715,781 | 6/1929 | Pein | 197/1 R |
| 1,732,104 | 10/1929 | Mee | 197/1 R |
| 2,251,616 | 8/1941 | Perry | 197/1 R |
| 2,320,637 | 6/1943 | Modigliami | 197/107 |
| 2,684,745 | 7/1954 | Blodgett | 197/107 X |
| 2,835,369 | 5/1958 | Schroder | 197/107 |
| 3,327,828 | 6/1967 | Dannatt | 197/107 X |
| 3,718,243 | 2/1973 | Chvatlinsky | 197/107 X |

*Primary Examiner*—J. Reed Fisher
*Assistant Examiner*—Paul J. Hirsch
*Attorney, Agent, or Firm*—Young & Thompson

[57] ABSTRACT

A key operated manual writing machine including a writing instrument which inscribes letters on the paper, the instrument being controlled by pairs of cams, each pair coupled to one of the manual keys. The two cams control movements of the pen or instrument in two directions x and y at right-angles.

2 Claims, 9 Drawing Figures

WRITING MACHINES

This invention relates to a writing machine of the general nature of a typewriter. The preferred machine is mechanically operated by the term "mechanically operated" in this context is to be understood to embrace not only manually operated machines but also mechanisms having an electrical power input.

Existing typewriters are bulky, heavy noisy and expensive and it is an object of the invention to provide an improved writing apparatus which will mitigate at least some of these disadvantages.

Broadly stated the invention consists in writing apparatus including a line writing instrument or pen, a plurality of keys, a plurality of mechanical memory stores arranged to provide double coordinate data, and means for controlling the movements of the writing instrument in accordance with a selected data store or stores on actuation of a corresponding key.

Thus from this aspect the invention is based on the concept of controlling the movements of the instrument while held in contact with the paper, as in normal handwriting, rather than to imprint a character on the paper as with a conventional typewriter. This feature provides or contributes to a number of potential advantages; it allows the overall dimensions to be reduced, reduces or eliminates the impact noise of a conventional printing type of machine, tends to reduce the effort needed to actuate the keys, and permits other improvements as will be apparent from the following description.

According to a preferred feature of the invention each memory store comprises one or more cams or cam followers. The cams or cam followers are conveniently mounted on one or a pair of common rotary drive shafts.

Preferably the writing instrument is movable longitudinally, i.e. along a line of writing, while the paper carrier or platen is stationary, and in a particular preferred construction the instrument is movable on a guide parallel with the cam drive shaft or shafts and the apparatus includes means for transmitting the cam controlled movements to the instrument at any longitudinal position thereof.

The machine may for example include means for moving the instrument in two orthogonal directions in response to movements of a pair of cam followers.

According to another preferred feature of the invention the apparatus includes interlock means for preventing or restraining actuation of two or more keys simultaneously.

Figures 1, 5:
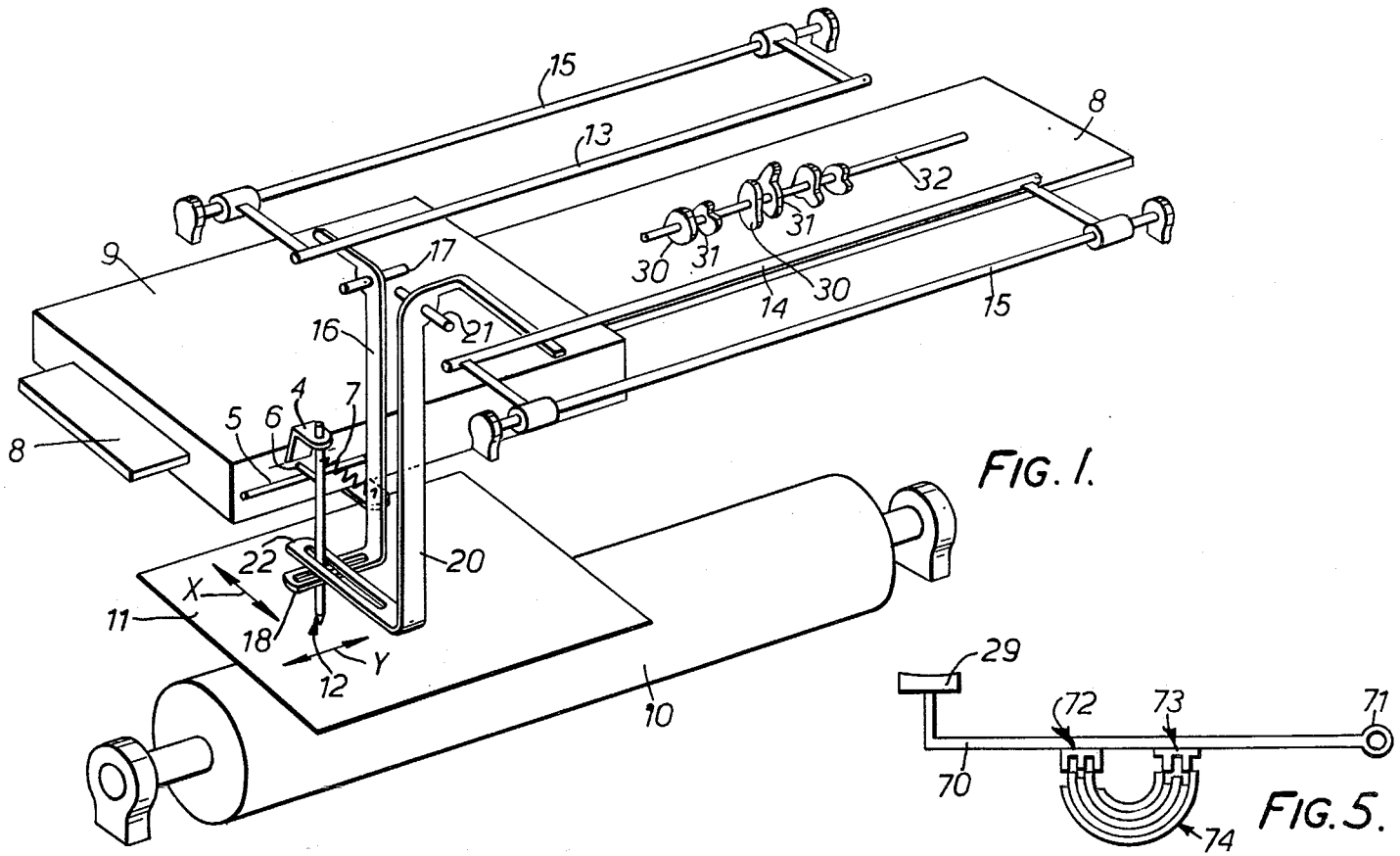
Figure 2:
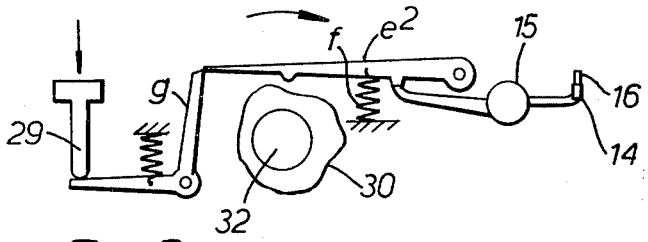
Figure 3:
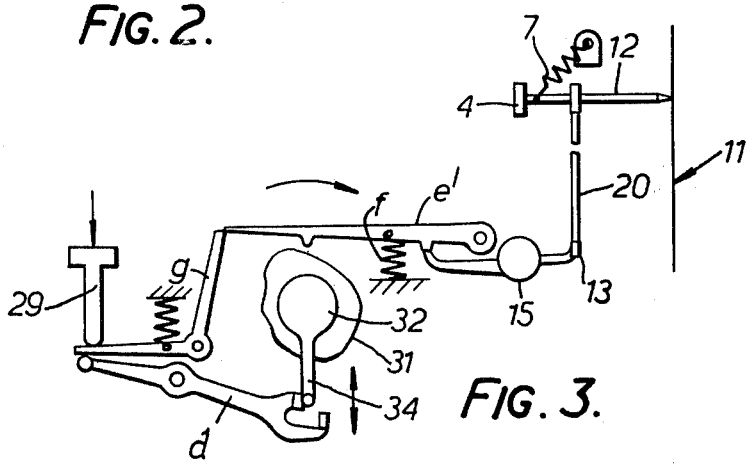
Figure 4:
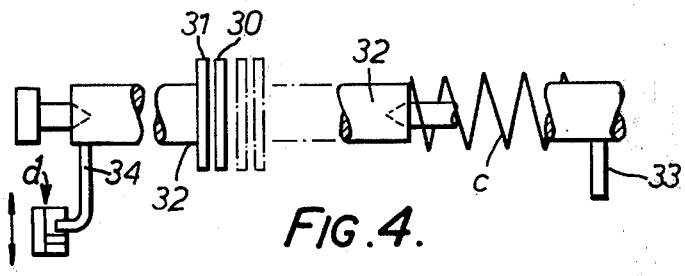
Figure 6:
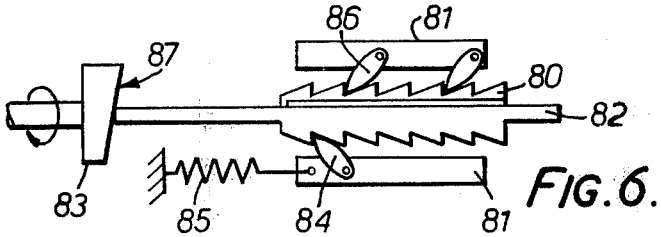
Figure 7:
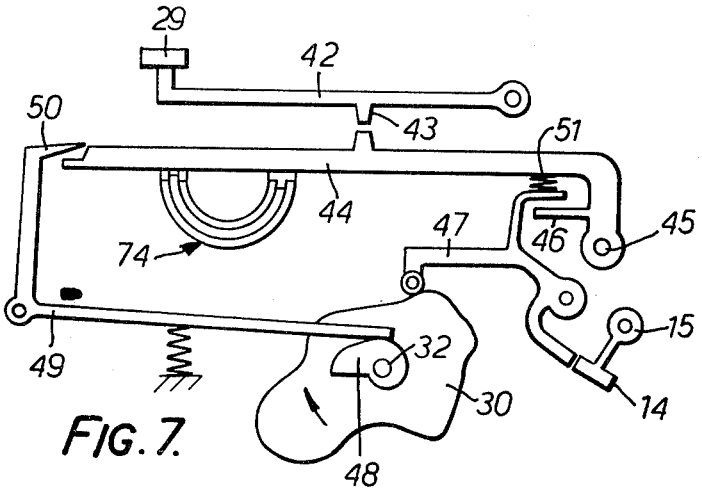
Figure 8:
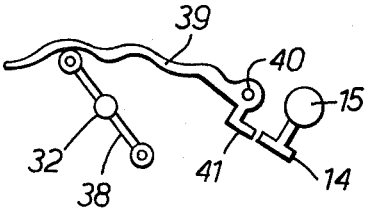
Figure 9:
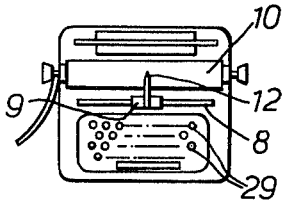

The invention may be performed in various ways and one specific embodiment with a number of possible modifications, will now be described by way of example with reference to the accompanying drawings in which:

FIG. 1 is a diagrammatic perspective view illustrating some of the essential mechanical components of a writing machine according to the invention, FIG. 2 is a diagrammatic end view on an enlarged scale illustrating one of the cam controlled mechanisms, FIG. 3 is a similar end view illustrating another associated cam mechanism, FIG. 4 is a front elevation of an escapement rotary drive to one of the cam shafts, FIG. 5 is a diagrammatic end elevation of an anti-jam interlock, FIG. 6 is a diagrammatic perspective view of a rack mechanism for moving the instrument length-wise, FIG. 7 is a diagrammatic side elevation of an alternative form of key mechanism, FIG. 8 is a diagrammatic side elevation of an alternative form of cam and cam follower mechanism, and FIG. 9 is a simplified plan view of the complete machine.

Referring first to FIG. 1 the apparatus comprises essentially a roller or platen 10 for locating a sheet of paper 11, and a writing instrument or pen 12 for inscribing the required characters or symbols on the paper. In FIG. 1 the sheet of paper is shown flat for convenience but in practice it will be wrapped around the platen. The platen roller does not move lengthwise and is merely indexed angularly in the normal manner to provide line spacing. In operation the pen 12 moves lengthwise along each line, being supported from a carriage indicated at 9 which is movable on a longitudinal guide 8, and the pen returns to its starting position for the next line. The pen is conveniently a ballpoint or similar instrument, capable of inscribing a continuous line, and is mounted to be capable of small simultaneous movements in two orthogonal directions as indicated by the arrows, X and Y. These movements are controlled by a pair of vertically movable rocker rails 13, 14 arranged parallel with a line of writing and each mounted to swing on a fixed horizontal pivot axis or shaft 15 so that it remains at all times truly horizontal. The rocker rail 13 is engaged by a bellcrank lever 16 mounted on a horizontal longitudinal pivot 17 carried by the carriage 9, and the lower tip of this lever has an arm 18 with a slot through which the pen 12 extends. This controls the movement of the pen in the direction X. Movement of the pen in the direction Y is controlled by a similar bell-crank lever 20 pivoted on a transverse horizontal pivot 21 carried by the carriage 9 and engaging the second rocking rail 14, the lower end of the lever 20 having another slotted arm 22 through which the pen passes. The pen is flexibly and resiliently supported at its upper end, from the carriage 9, by means including a spring 7, which urges the pen sideways and towards the paper, and attached to the pen is an arm 6 engaged by a vertically movable rail 5, by which the pen can be lifted off or dropped onto the paper when desired. The upper end of the pen can pivot and slide in a bracket 4 on the carriage. The rail 5 is actuated by a manual key on the machine, or by a cam on the camshaft 32.

Thus it will be seen that by proper control of the two rocking rails 13, 14 simultaneously, the pen can be made to trace out any required symbol or character on the paper. The movements of the rails 13, 14 are governed by cooperating pairs of rotary cams 30, 31 on the common cam shaft 32 mounted on the main framework of the machine. Each cam is associated with a cam follower which engages the respective rocking rail and the cam followers are moved into operative positions in response to movements of the normal letter keys. Thus until a key is depressed no movement is applied to either rocking rail and the pen is stationary.

One of the cam and cam followers mechanisms is illustrated in more detail in FIGS. 2 and 3. Each cam pair consists of one can 30 (see FIG. 2) shaped or contoured to control the horizontal or *y* component of the character required to be traced by the pen and another cam 31 (FIG. 3) shaped to control the vertical or *x* component of that same character. The cam pairs may either be individually rotated by their appropriate key 29, or more simply as illustrated they may be keyed together on the common cam shaft 32 and rotated by a spring *c* (see FIG. 4). The spring may be wound either by a motor (not shown) or by a common lever 33 actuated by the descent of the keys.

The cam shaft is normally restrained from rotating under the driving power of spring *c* by an escapement lever *d*. Poised over the respective cam is a pivoted follower $e^1$,$e^2$, pulled towards the cam by a spring *f*. Each follower is normally held clear of its cam by a spring loaded trigger lever *g*. Allocated to each pair of cams is a single letter key 29 so arranged that when manually depressed to the end of its stroke it simultaneously activates the two followers $e^1$ and $e^2$ by release of their respective triggers *g* and at the same time releases the cam shaft 32 by depressing the escapement lever *d* which is thus released from an arm 34 attached to the cam shaft when any one of the letter keys 29 is depressed.

The escapement *d* is designed to permit just one revolution of the shaft 32 and the cams 30, 31 when a key is depressed to the limit and released. Release of the selected triggers *g* permits the descent of the selected followers $e^1$and $e^2$, and allows the followers to oscillate under the control of the cam contours. The movements of the followers are then communicated to the pen 12 by the rocker rials 14, 13 via the levers 20 and 16 for the horizontal and vertical components respectively. The spring 7 pulls the pen both downwards and laterally, so that the pen holds the levers 16 and 20 against the rocker rails 13, 14, thus maintaining close contact.

FIG. 5 illustrates an anti-jam key interlock mechansim. Each key arm 70 is pivoted at 71 and has a number of small coded "pips" 72, 73 on its under surface. Each pair of pips 72, 73 is arranged to combine with a series of five concentric half tubes 74 extending lengthwise below all the keys of a bank. The pairs of pips 72, 73 on each key are so arranged that each is an inverse image of the other and when a key is depressed the tubes 74 are rotated into individual positions where both edges of each tube are engaged by the pips 72, 73 and each tube is thus positively located and locked. With the tubes locked in these coded positions no other key in that bank can then be depressed until the tubes are released. In this way the mechanism prevents a second key being depressed until the first key has been released. The tubes may be held frictionally or resiliently so that a form of override can be achieved, and a subsequent key depressed very heavily may overcome a previous key held down more lightly. This may be useful for various purposes such as correction but still avoids simultaneous depression of two keys.

For writing upper and lower case letters a modification may be provided in the form of an outer sleeve with external "capital" cams surrounding the cams 30, 31 on the cam shaft 32. By moving the outer sleeve through a predetermined distance (using a capitals key) the cam followers are effectively switched from the inner cams to the outer cams thus varying the coordinate movements so that capital letters are inscribed.

It will be appreciated that many modifications are possible within the overall aspect of the invention. For example each pair of rotary cams may be replaced by a single cam having two semi-circular half profiles, with two cam followers on opposite sides, or a single two-dimensional cam having for example an edge profile with a sinuous cam groove formed in the edge. Also instead of using triggers *g* the manual keys 29 may be arranged normally to hold the followers $e^1$, $e^2$ clear of the cams, and to allow the followers to fall when the keys are depressed.

FIG. 6 shows a method of feeding the pen or instrument length-wise during the forming of the characters. A fixed rack 80, which also serves as a guide rail, supports a pen cariage 81. A movable rack 82 is operated by a cam 83 with an inclined end face 87, which is coupled to the letter forming cams 30, 31. Each rotation of the cam shaft 32 moves rack 82 a distance of one tooth which corresponds to the width of a letter. This in turn transverses the pen carriage to the right against a return spring 85 by means of pawl 84. The pen carriage is held in position during the return stroke of the rack 82 by pawl 86 engaging the fixed rack 80.

FIG. 8 illustrates another form of cam and cam-follower mechanism according to the invention, which has certain advantages over the constructions shown in FIG. 2. In FIG. 8 the roles of cam and cam follower are interchanged. The rotating shaft 32 carries a pair of elongated blades or paddles 38, with rollers at their extremities, and each follower $e^2$ of FIG. 2 is replaced by a lever 39 having a profiled under surface which is engaged by the blades as the shaft 32 rotates. This arrangement is of advantage in that the profiled cam edges on the levers 39 can be positioned extremely close to one another, and since these cam edges move relatively to each other in operation there is less tendency for dirt to accumulate in the intervening groove. FIG. 8 also illustrates a preferred feature of the invention for reducing the inertia effect of the rocker rails 13 and 14. As shown the rail 14 is located relatively close to the pivot 15, and its movement is relatively small. The cam follower lever 39, pivoted at 40, has a short projecting arm 41 which provides a step-down ratio between the movement imparted by the blades 38, and the movement of the rail 14. In the final lever linkage 16 between the rocker rail and the pen 12 the movement is stepped up again to the desired value. This reduces the inertia effect of the rocker rail, whose mass is appreciable since it extends the full length of the writing platen.

In FIG. 7 the manual key 29 is mounted on a lever 42, having a projection 43 to engage a key lever 44, pivoted at 45, and formed with a lifting element 46 engaging part of a pivoted cam follower lever 47 which actuates the rocker rail 14, and so controls the pen 12. When the shaft 32 starts to rotate a secondary cam 48 releases a bell crank lever 39 and a latch 50 moves over the end of lever 44 and holds this lever down until the shaft has turned through one revolution, and the character has been completed. During this movement a spring 51 holds the cam follower 47 in contact with cam 30, but at the end of the revolution the latch 50 withdraws and the follower can lift off the cam so that the pen is stopped.

I claim:

1. A writing machine including a writing instrument, means for moving said instrument longitudinally in relation to a writing surface, and mounting means permitting movement of said instrument in two orthogonal directions, a plurality of mechanical memory stores for controlling the movements of said instrument in said two orthogonal directions, each said memory store comprising first and second cooperating cam elements, all of the first cam elements of said memory stores being mounted for simultaneous rotation on a common drive shaft, and all of said second cam elements being independently movable relative to each other, motion transmitting means operatively connecting each of said second cam elements to said instruments, said transmitting means including an actuating rail extending parallel to the longitudinal movement of said instrument, and means for moving said rail in a direction transverse to its length, and a plurality of manual keys each operatively associated respectively with one of said pairs of cooperating cam elements and acting selectively to connect said cam elements with said instrument, said actuating rail being pivotally mounted for rocking movement about an offset axis parallel to the length of said rail, each of said second cam elements comprising a step-down mechanical transmission such that the movement of said rail is less than the corresponding movement of the respective first cam elements, the motion transmitting means connected between said rail and said instrument comprising a step-up mechanical transmission which provides increased movement of said instrument in relation to the movement of said rail.

2. A writing machine including a writing instrument, means for moving said instrument longitudinally in relation to a writing surface, and mounting means permitting movement of said instrument in two orthogonal directions, a plurality of mechanical memory stores for controlling the movements of said instrument in said two orthogonal directions, each said memory store comprising first and second cooperating cam elements, all of the first cam elements of said memory stores being mounted for simultaneous rotation on a common drive shaft, and all of said second cam elements being independently movable relative to each other, motion transmitting means operatively connecting each of said second cam elements to said instrument, said transmitting means including an actuating rail extending parallel to the longitudinal movement of said instrument, means for moving said rail in a direction transverse to its length, and a plurality of manual keys each operatively associated respectively with one of said pairs of cooperating cam elements and acting selectively to connect said cam elements with said instrument, and an interlock device to deter simultaneous actuation of two keys, including a plurality of parallel part-tubular interlock members, each mounted for independent pivotal sliding movement about an axis parallel to its length, and coded stop means on each key arranged to engage simultaneously with opposite edges of each interlock member on opposite sides of said pivotal axis and thereby locate said interlock member in a deterrent position to resist actuation of a subsequent key.

* * * * *